US005444630A

United States Patent [19]

Dlugos

[11] Patent Number: 5,444,630

[45] Date of Patent: Aug. 22, 1995

[54] METHOD AND APPARATUS FOR APPLYING CUSTOMIZED RATING ADJUSTMENTS TO TRANSACTION CHARGES

[75] Inventor: Daniel F. Dlugos, Shelton, Conn.

[73] Assignee: Pitney Bowes Inc., Stamford, Conn.

[21] Appl. No.: 175,012

[22] Filed: Dec. 29, 1993

[51] Int. Cl.[6] ..... G07B 17/02

[52] U.S. Cl. ..... 364/464.02; 364/464.03

[58] Field of Search ..... 364/404, 405, 464.01, 364/464.02, 464.03, 464.04, 466, 465, 467

[56] References Cited

U.S. PATENT DOCUMENTS

| | | | |
|---|---|---|---|
| 4,084,242 | 4/1978 | Conti | 364/466 |
| 4,138,735 | 2/1979 | Allocca et al. | 364/567 X |
| 4,495,581 | 1/1985 | Piccione | 364/466 |
| 4,499,545 | 2/1985 | Daniels et al. | 364/464.02 |
| 4,504,915 | 3/1985 | Daniels et al. | 364/466 |
| 4,595,984 | 6/1986 | Daniels | 364/466 |
| 4,763,271 | 8/1988 | Field | 364/466 |
| 5,072,397 | 12/1991 | Barns-Slavin et al. | 364/464.02 |
| 5,117,364 | 5/1992 | Barns-Slavin et al. | 364/464.03 |
| 5,161,109 | 11/1992 | Keating et al. | 364/464.02 |
| 5,293,310 | 3/1994 | Carroll et al. | 364/408 |
| 5,337,246 | 8/1994 | Carroll et al. | 364/464.02 |

*Primary Examiner*—Edward R. Cosimano

*Attorney, Agent, or Firm*—Robert H. Whisker; Melvin J. Scolnick

[57] ABSTRACT

The method for applying rating adjustments includes the storage of transformation data for a number of levels of discount rates which are applied at selected times in accordance with criteria such as time or monetary amounts attained. Each set of transformation data is kept one-to-one with respect to base rate data in respect of a plurality of desired parameters. The method allows changes to be made in the various levels of discounts and surcharges without disturbing other levels. The calculations may be made in real time in a user's system or a final convolution of a rate chart may be accomplished at a data center and quickly downloaded as required to the user's system.

5 Claims, 5 Drawing Sheets

OVERALL SYSTEM

USER SYSTEM INTERNAL INTERFACE DIAGRAM

DISCOUNT/SURCHARGE DATABASE

METHOD AND APPARATUS FOR APPLYING CUSTOMIZED RATING ADJUSTMENTS TO TRANSACTION CHARGES

FIELD OF THE INVENTION

The invention relates to data processing methodology and apparatus for effecting customized rating adjustments to transaction charges. More specifically the invention is directed to a system for improved ease and reliability in changing discount rates applied to transaction charges in a shipping system.

BACKGROUND OF THE INVENTION

It is well known in the carrier shipping industry to distribute standardized charts public rates for manifest mail carrier systems. These standard rates are available to anyone who meets the basic conditions for doing business with the carrier. Each carrier typically also offers several standard classes of service. Rates may be based on items such as service level, weight, distance and the like.

In addition to the standard rates offered, for competitive reasons a carrier may wish to offer special discounted rates individually to preferred customers. These custom rates are typically individually negotiated. The structure for these rates then will be a standard base rate suitable for all shippers less an individualized discount structure based on parameters such as the weight and zone to which a package is shipped.

In application Ser. No. 887,616, filed May 22, 1992, entitled FLEXIBLE APPARATUS AND METHOD FOR APPLYING CUSTOMIZED RATING ADJUSTMENTS TO TRANSACTION CHARGES, now U.S. Pat. No. 5,337,246, and assigned to the assignee of the present application, there is described a system for automatically processing this transaction data. The memory of the computer in accordance with this referenced application contains data bases with authorized security access codes, standard rates, and data for individual discount rates which are accessed and applied to charges initially computed using the standard rate structure to determine the actual fee based on the various rates.

While this has worked well for the user and is useful in conventional devices such as the Hawk, A2000, and A10000 marketed by Pitney Bowes, the application discloses that a particular final discount chart or program is generated for each carrier and forwarded to the shipper. The national and regional rates and any surcharges are combined at one level into a single discount or surcharge to the overall base rate to provide the overall charges. Other systems provide to each user a single convoluted chart for determining the final charge including any discounts. This chart requires extensive changes each time any one of the various rates is changed. These charts are labor intensive with a required quick turnaround time and as a consequence errors can readily occur and it has been found that the charts require extensive tests so as to assure reliability.

SUMMARY OF THE INVENTION

It is therefore an object of the invention to provide a rate chart generating system which overcomes the problems associated with changing an entire discount chart at one time.

It is a further object of the invention to provide a method for changing rate charts which requires a minimum of change and in which incorporation of changes may be readily accomplished in one set of rates or surcharges without disturbing other rate data bases in the system.

The above and other objects are attained in a method of generating a charge for a selected transaction comprising the steps of providing an apparatus for computing the charge, said apparatus having means for storing data for use for calculation of a rate associated with the transaction, storing a plurality of selected rate charges for a plurality of respective transactions, providing a plurality of respective sets of rate transform data operative for generating a transition from a first level of rates for a selected transaction to a second level of rates for the selected transaction for application to the calculation of charges for the selected transaction, said sets of rate transform data being segregated into regions having at least a portion thereof in one-to-one correspondence with the rate charges of in each level for each of a plurality of parameters associated with the rate transforms, selecting one of said sets of rate transform data in accordance with another determined parameter for determining a final rate, and, thereafter calculating the charge for the transaction.

DESCRIPTION OF THE PREFERRED EMBODIMENT

Figure 1:
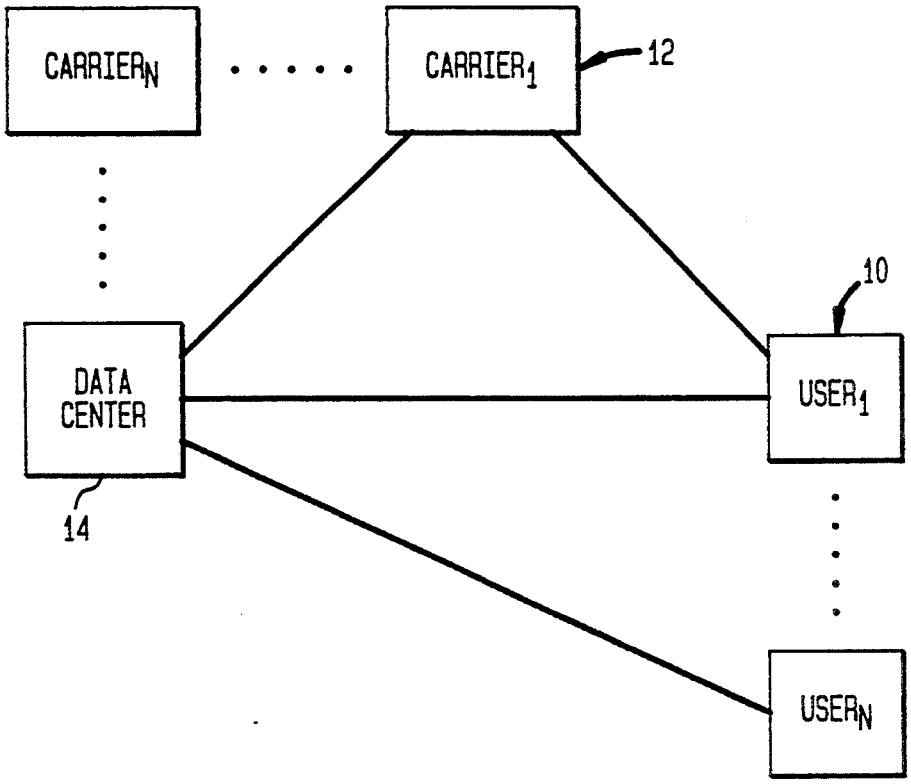
FIG. 1 is a functional block diagram illustrating the relationship between a data center, carriers, and users of the system.

In FIG. 1, there is shown generally an overall system in which the invention may reside. In the embodiment illustrated, the system comprises a plurality of user stations 10 which may be coupled to a data center 14 by means of a communication link. Communications typically include delivery of Programmable Read Only Memory devices (PROM's) or discs for storing rate charts and discount or surcharge data to users 10 for installation in manifest systems or the like. It will be appreciated that the data may also be downloaded to users via a data link if desired. The data center is also able to receive information from a plurality of carriers 12 relating to the carrier rates and discounts made available to a particular user. Further details are available from application Ser. No. 887,616, filed May 22, 1992, entitled FLEXIBLE APPARATUS AND METHOD FOR APPLYING CUSTOMIZED RATING ADJUSTMENTS TO TRANSACTION CHARGES, now U.S. Pat. No. 5,293,310 assigned to the assignee of the present application, and specifically incorporated by reference herein.

Typically a user station 10 requests a preference for custom discount rates from a particular carrier 12. If a particular discount is negotiated, the data center is informed and a new rate chart is communicated to the user for installation in a device such as illustrated in FIG. 2.

Figure 2:
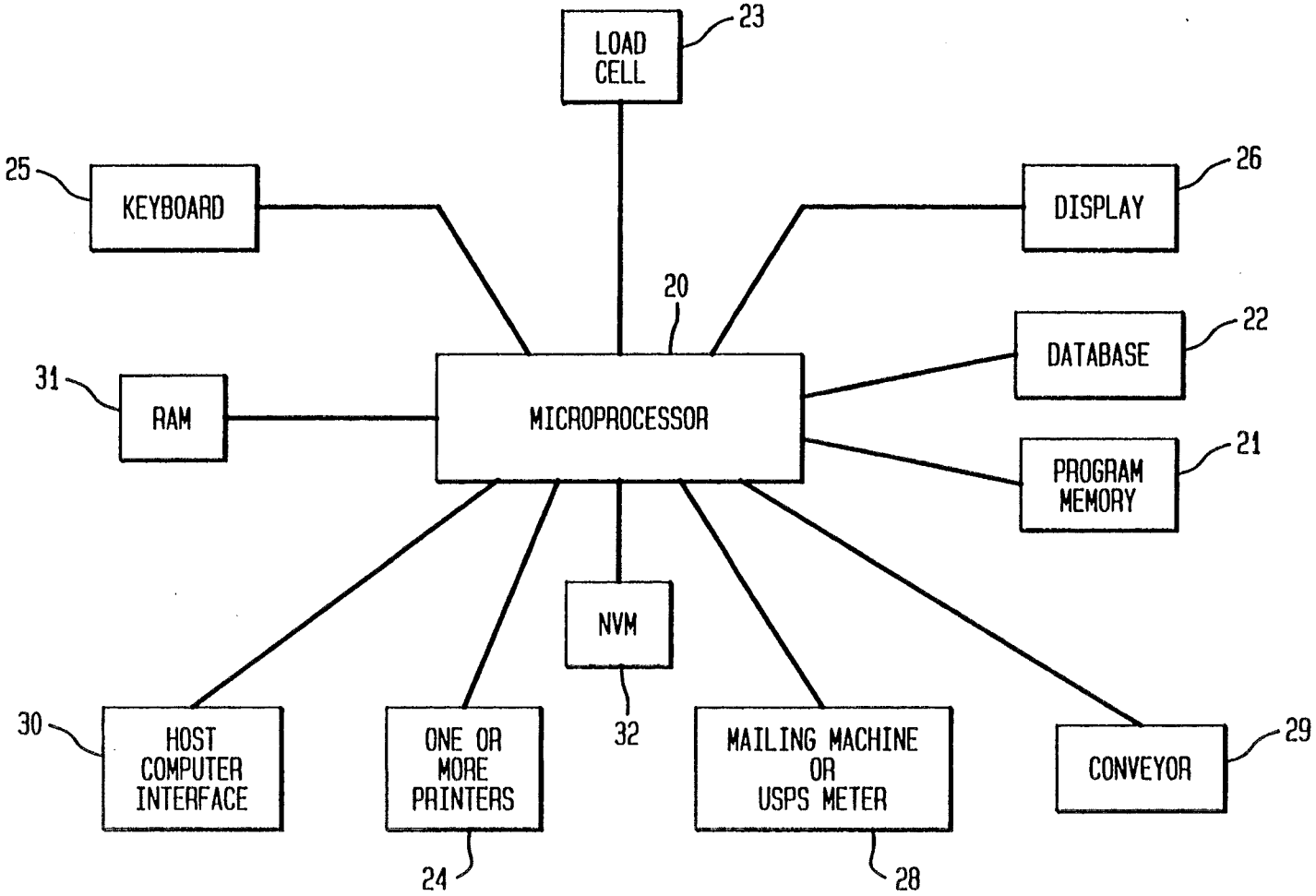
FIG. 2 illustrates a block diagram of a user station.

FIG. 2 is a block diagram of a user station. The system incorporates a microprocessor 20 having a non-volatile memory 21 containing the operating program and a non-volatile memory 22 for storing the rate information for the carriers for which the system is to calculate rates. This memory is preferably replaceable for the purpose of updates as previously described. A load cell 23 or other suitable scale device may be coupled to apply weight data to the microprocessor. One or more printers 24, a keyboard 25 and display 26 may be remotely situated if desired. The system may be connected to a meter 28, conveyor 29, and host computer interface 30. The system may also have further working RAM 31 and NVM 32 as required. It will also be appreciated that the system is quite usable in other environments.

This system is used to generate manifest reports to accompany shipments made by the carrier. The contents of such manifest reports are well known and will not be further discussed here. At the same time the data center management is responsible to both carrier and user for assurance of accurate rates in the user's system. As brought out above, the generation of the changed data in the system's rates may be quite time consuming and simply not available as quickly as the needs arise.

Figure 3:
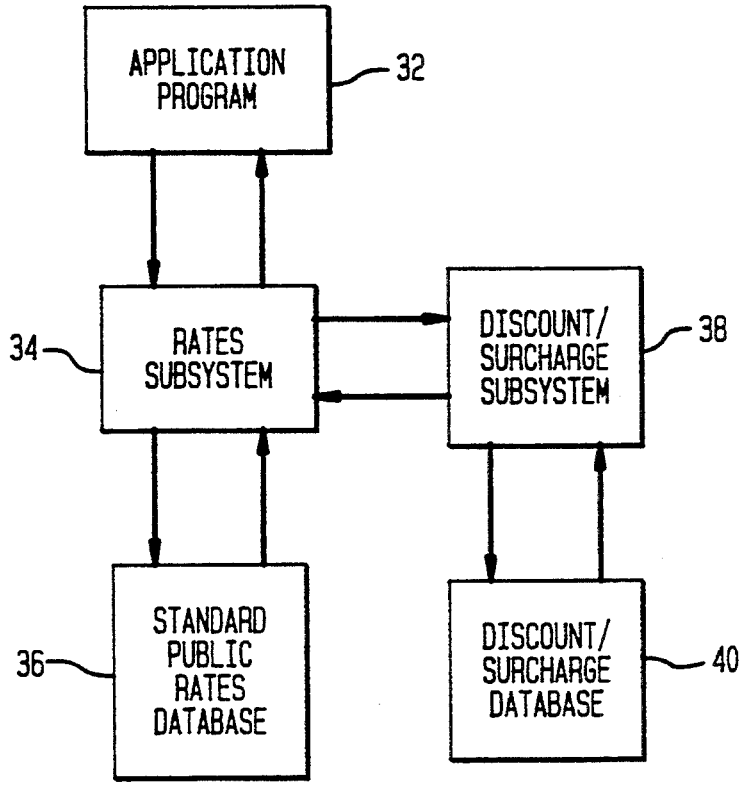
FIG. 3 is a partial map of the memory store of the user station.

Referring now to FIG. 3, there is shown in the memory store of the user station 10 an application program 33, the rates subsystem 34, the standard public rates data base 36, the discount/surcharge subsystem 38 and the discount/surcharge data base 40. The application program 33 calls the rates subsystem 34 when performing the rate calculation for a given transaction. The rates subsystem accesses data in the standard rates data base 36 in order to calculate the actual base rate. The rates subsystem 34 will call the programs of the of the discount/surcharge subsystem when performing calculations of discounts or surcharges. The discount/surcharge system 38 will reference the data in the discount-/surcharge data base 40 in order to calculate the appropriate discount or surcharge. The application program receives this information back from the rates subsystem for use in its output as is well known in the art. Further details of this device are available from app. Ser. No. 887,616, now U.S. Pat. No. 5,337,246 previously incorporated by reference. In this previously referenced app. Ser. No. 887,616, now U.S. Pat. No. 5,337,246 the National and Regional Discounts, for example, along with the appropriate surcharges are all combined into a single discount to be applied to the base rate. One of the problems with this approach is that various ones of the discount rates such as the local discounts are changed independently from others and may be introduced periodically in particular time frames, typically, for example, for seasonal variations. National discount rates on the other hand tend to be negotiated on an annual basis.

Figure 4:
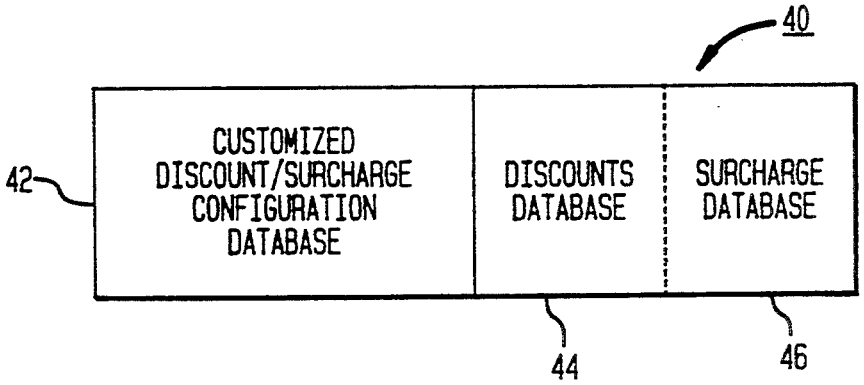
FIG. 4 is an expanded schematic depiction of Discount/Surcharge Data Base in accordance with the invention.

In FIG. 4 is shown an expanded version of the Discount/Surcharge Data Base 40 in accordance with the invention. In accordance with the invention, Data Base 40 comprises a plurality of data bases, each of which may be modified with no impact on the others. As illustrated in FIG. 4, each of these levels of discount such as the National Discount Rate 42, a plurality of sets of available local rates 44, and a plurality of surcharges 46 is separate from the other such that each level is not absorbed into a single level but is used to transform a previous value to a new compounded value. This new value is then used at the next level to determine the charge for service or for the calculation of additional discounts or surcharges. It will be understood that in accordance with the invention, various of the levels can be combined if desired into a single level.

Figure 5:
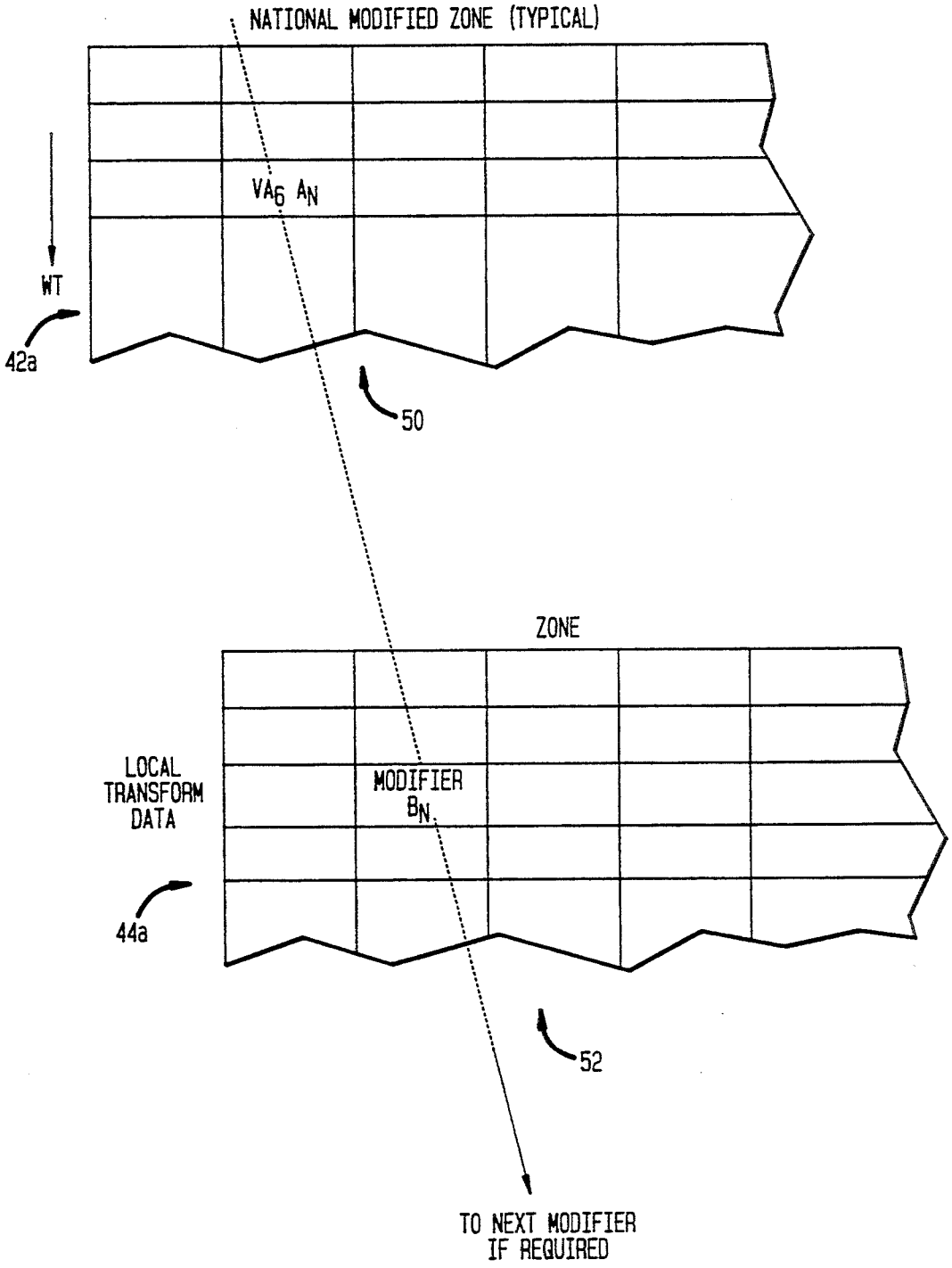
FIG. 5 is schematic depiction of a layer of transformation data such as a local discount level.

As best seen in FIG. 5 which shows the regions of illustrative particular transformation data layers, for example one of the national rate level modification layers **42*a* and a local rate level or layer identified here as 44*a*. Each cell of a layer of transformation data is associated with the appropriate cell of the base chart and cells of other with for example, every pound, ounce, kilogram vs. zone, region, distance, (a portion of which is indicated at 50 and 52**) vs. number of packages,letters, tubes, envelopes, vs. time of delivery, vs. urban, suburban, rural, wilderness and/or other breakdowns as desired, such as residential vs. commercial or the like, these not being shown in FIG. 5. It will be understood that the transformation data may include multipliers, subtractions or additions, or algorithms for determining a new discount rate for a next level. In accordance with the invention, it is necessary that the changes in the calculations in one level are not affected by changes at another level.

Figure 6:
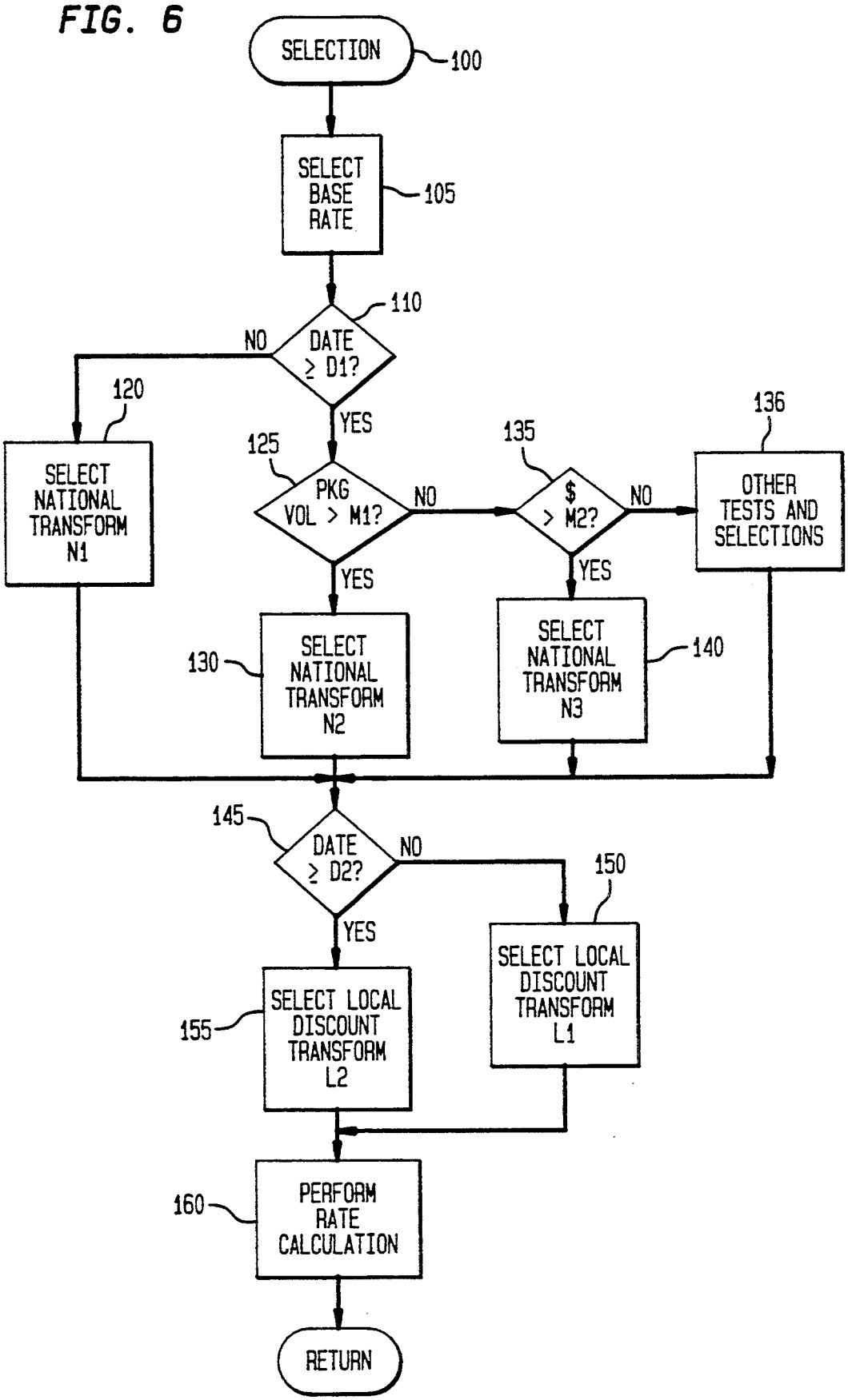
FIG. 6 is a flow chart illustrating the selection of various discount levels.

The significant advantage of the method is that multiple discount levels may be provided and selected as illustrated in FIG. 6. FIG. 6 is a flow chart illustrating the selection of various discount levels. These various discount levels may be switched on at the appropriate agreed upon trigger which is illustrated in FIG. 6 as "date." However, it will be understood that the trigger may be a date, a quantity or a dollar value. In this way, there would not only be incentive targets for a customer but automatic switching whenever the trigger event is reached.

As shown in FIG. 6, at 100, a base rate for a transaction is selected at 105 and a test is made at 110 to determine if a date is greater or equal to a given data. If NO, at 120 the program executes the National Transform data set N1. If YES, at 125 the program selects one of alternative National Transform data sets, N2 or N3. Thus by testing characteristics of a transaction such as the time it occurred discount (or surcharge) structures may be scheduled to take affect at various times. Of course those skilled in the art will recognize that other tests such as tests of total weight, charges billed, or number of units may be substituted for, or combined with, test of the time of occurrence to activate new structures. If, in the preferred embodiment shown, at 125 the package volume is greater than a predetermined threshold M1, then at 130 the program selects National Transaction data set N2, and if at 125 the result is NO, then at 135 the program tests to determine if the dollar amount of charges previously billed is greater than a threshold M2, and if yes, at 140 the program selects National Transform data set N3. If at 135 the result is No then at 136 the program performs other test and makes other selections, whose general nature can be determined from the needs of the application and will be readily apparent to those skilled in the art, and which need not be described in any greater detail for an understanding of the subject invention.

After selection of the National Transaction data set, then at 145 the program tests to determine if the date is greater then or equal to a second given date. If at 145 the result is No then at 150 the program selects Local Transform L1, and otherwise at 155 selects Local Transform L2. Then, in either event, at 160 the program calculates a rate by calculating a first level rate by applying the National Transform data selected to the Base Rate determined at 105; and then calculating a second level rate by applying the Local Transform data selected to the first level rate; as described above with respect to FIG. 5. The program then returns to calculate charges as described above with respect to FIG. 3. When all selections have been made, the routine calculates the final rate at 160 and returns. As stated previously, the use to which the calculations are put in generating manifests are well known and will not be described here.

It will also be understood that this method for generating rates, instead of being applied dynamically by the user's system, can be applied off-line to generate the final rate chart as previously described for conventional systems. Such an off-line utility could be applied to systems not having the upgraded capability of performing dynamic real time discounting. It will be appreciated that the rate chart may be changed in correspondence with a trigger or time in accordance with an agreement between the carrier and its customer. In order to protect the carrier, the data center on demand could produce an equivalent code string would identify the complete discount definition for each customer It is apparent that the underlying base chart also may be in this manner subjected to rapid change or even periodic predetermined change using such switching techniques. The method provides protection for the carrier or service provider so that he can change the underlying base chart without having to disturb the individual customized discount levels.

The above description has mainly been described in terms of a single carrier and it will be understood that multiple carriers may be accommodated by means of multiple data bases or through a single data base relating to all carriers. It will also be appreciated that the determination of discounts and surcharges may include other parameters than the one illustrated herein and it will be apparent also that the system has applications in other contexts such as systems for calculating charges for telephone calls or other like services requiring discount calculations.

What is claimed is:

1. A method of calculating a charge for a selected transaction, the method comprising the steps of:

a) providing an apparatus for calculating the charge, the apparatus having means for storing a first database for determining base rates for transactions, the first database being partitioned into cells in accordance with first parameters characterizing the transactions, and means for storing a second database, said second database including a plurality of sets of transform data for transforming the base rates into a second level rates, each of said sets of transform data being partitioned into cells in accordance with the first characterizing parameters;

b) inputting the first characterizing parameters and second characterizing parameters for the selected transaction to the apparatus;

c) controlling the apparatus to select one of said sets of transform data in accordance with the second characterizing parameters, d) controlling the apparatus to select a first cell in the first database and a second cell in the selected set of transform data in accordance with the first characterizing parameters;

e) controlling the apparatus to calculate a base rate for the selected transaction in accordance with data from the first cell.

f) controlling the apparatus to calculate a second level rate for the selected transaction in accordance with the base rate and transform data from the second cell; and g) controlling the apparatus to calculate the charges for the selected transaction in accordance with a last calculated rate.

2. A method as described in claim 1 wherein at least some of the second characterizing parameters are distinct from the first characterizing parameters.

3. A method as described in claim 2 wherein one of the second characterizing parameters is the time of the selected transaction.

4. A method as described in claim 1 wherein the second database includes a second plurality of sets of transform data for transforming second level rates into third level rates each of said sets in said second plurality being partitioned in accordance with said first characterizing parameters, and the method including the further steps of;

a) controlling the apparatus to select one of said second plurality of sets of transform data in accordance with said second characterizing parameters;

b) controlling the apparatus to selecting a third cell from the set selected from the second plurality in accordance with the first characterizing parameters; and c) controlling the apparatus to calculate a third level rate in accordance with the second level rate and transform data from the third cell before calculating the charges for the selected transaction.

5. A method as described in claim 4 comprising the further step of updating the first plurality of sets of transform data and the second plurality of sets of transform data at different times.

* * * * *